United States Patent [19]

Gablin et al.

[11] 4,010,108

[45] Mar. 1, 1977

[54] RADIOACTIVE WASTE DISPOSAL OF WATER CONTAINING WASTE USING UREA-FORMALDEHYDE RESIN

[75] Inventors: Kenneth A. Gablin, Burton; Larry J. Hansen, Tacoma, both of Wash.

[73] Assignee: Nuclear Engineering Company, Inc., Louisville, Ky.

[22] Filed: Nov. 29, 1973

[21] Appl. No.: 420,008

Related U.S. Application Data

[63] Continuation of Ser. No. 220,449, Jan. 24, 1972, abandoned.

[52] U.S. Cl. ..... 252/301.1 W

[51] Int. Cl.[2] ..... G21F 9/16; G21F 9/12; C02B 1/32

[58] Field of Search ..... 252/301.1 W

[56] References Cited

UNITED STATES PATENTS

| | | | |
|---|---|---|---|
| 3,142,648 | 7/1964 | Lefillatre et al. | 252/301.1 W |
| 3,298,960 | 1/1967 | Pitzer | 252/301.1 W |
| 3,513,100 | 5/1970 | Stogner | 252/301.1 W |
| 3,634,230 | 1/1972 | Odom et al. | 252/301.1 W |

OTHER PUBLICATIONS

Kaetsu et al., *N.S.A.*, 23, p. 2668 No. 26286 (1969).
Erben et al., *N.S.A.*, 23, p. 2227–2228, No. 21922 (1969).
Houwirk et al., *Adhesion and Adhesives*, vol. 1, pp. 187–236, Elsevier Publishing Company (1965) New York.
Bonniaud et al., "Energie Nucleaire", 2 No., 22–26 (1960).

*Primary Examiner*—Edward A. Miller
*Attorney, Agent, or Firm*—Schapp and Hatch

[57] ABSTRACT

A method of disposing of wet radioactive waste materials such as those generated in the water used to cool atomic reactors, comprising combining the waste material with a hydrophilic resin in proportions sufficient to provide a solid mass of the resin with the radioactive waste component distributed within. In its preferred form, the waste material is concentrated by separating water from the radioactive portions thereof by methods such as evaporation, taking up the waste components with an ion exchange resin and separating the resin from the bulk of the water, or by the addition of flocculating agents or the like and filtering. The preferred hydrophilic resinous material is a conventional urea-formaldehyde dispersion, which is partially polymerized and capable of taking up water and fully polymerizing upon the addition of an acidic curing agent. The method also contemplates adding a substantially waterproof resinous material to the surface of the solid block, or enclosing it in a waterproof container, or both.

21 Claims, No Drawings

RADIOACTIVE WASTE DISPOSAL OF WATER CONTAINING WASTE USING UREA-FORMALDEHYDE RESIN

This is a Continuation of application Ser. No. 220,449 filed Jan. 24, 1972, and now abandoned.

BACKGROUND OF THE INVENTION

The present invention relates to improvements in RADIOACTIVE WASTE DISPOSAL, and more particularly to the disposal of radioactive materials by immobilizing them within a solid mass for storage and/or burial.

It is well known that waste products occur as a natural result of activity involving the use of radioactive isotopes. For example, waste products are provided during the operation of atomic reactors and the like, and these waste products may be produced directly from primary radiation sources or secondarily by the creation of isotopes from non-radioactive metals or the like. In order to assure smooth efficient continuation of atomic processes generating such waste material, efficient disposal means must be provided both for primary and secondary waste products.

At the present time, disposal has been achieved by immobilizing the waste in a solid block, and then by disposal at sea or by burial in a specially designated burial site. Burial at sea requires more and more preparation, because of the long range effects of certain pollution components that might build up. When the product is disposed of at a burial site, it is also necessary to provide safe means for transporting the material to the burial site. In addition, it is important to assure the containment and safe storage of the material at the burial site for a time sufficient to allow a sufficent decay of the radioactive components to reduce the radiation intensity thereof to a relatively safe level. Thus it is seen that whatever the disposal of the waste material, it is important to provide means for protecting the material and assuring its safe storage at the disposal site for a long period of time.

Prior to this invention, Portland Cement has been in rather widespread use for the purpose of encapsulating and holding radioactive waste material therewithin so as to provide a protective block for the material at the burial site. Portland cement has been found to be particularly advantageous where the radioactive waste material is present in water, and it is advantageous to dispose of a certain amount of water along with the radioactive waste material in order to provide an efficient handling process.

For example, the water utilized in the cooling loop of atomic reactors tends to accumulate contaminations of radioactive nickel and cobalt probably as a result of conversion of iron and/or nickel in the tubes carrying the water. In any event, these materials build up in the water so that it is important to remove the waste from time to time in order to prevent a buildup from reaching a very hot or hazardous level. In such a case, probably the most serious component is cobalt 60, because it emits hard gamma rays and has a half-life of approximately five years.

Prior to this invention, the cooling water was removed and mixed with Portland Cement in the usual water-cement ratio, allowed to solidify and then the block of cement buried in a waste dump. Such disposal has been generally satisfactory for many operations, but it has a number of disadvantages. One of the disadvantages resides in the heavy weight of the cement and the like, which must be transported often over a considerable distance. Another disadvantage, and perhaps a more serious one, resides in the fact that many waste products of this general class now contain levels of boron material that render disposal in Portland Cement unsatisfactory or impossible because of the lack of compatability of the materials. Other areas of improvement are also seen to be available, such as the handling problems occuring with cement in processing equipment and the possibility of the cement setting up in an undesired fashion during an unexpected shutdown. Rather than go into all of the disadvantages of the cement process, it is proposed to provide an improved process in which certain advantages are achieved, and which is particularly suitable for disposing of waste products having high concentrations of compounds containing boron.

Another problem which has been of some concern with the use of Portland Cement is the possibility of the radioactive material leaching therefrom. This problem is particularly acute where disposal at sea is contemplated, and efforts to utilize materials other than Portland Cement have generally been in the area of the use of hydrophobic materials so as to render the solid block substantially leach-proof. However, the use of hydrophobic materials such as bitumen or asphalt has a number of disadvantages particularly in the mixing and processing steps, and the use of these materials has generally been rejected as not substantially improving the situation involved with the use of Portland Cement.

SUMMARY OF THE INVENTION

From the above background material, it is seen that a primary object of the present invention is to provide a process for making a disposable waste product material in which improvements are made over the use of Portland Cement in order to increase the range of disposable materials, provide reduction of weight required for shipping, and generally provide a more reliable disposal from the standpoint of safety and the like.

These and other objects are achieved by solidifying the wet or water-carried waste product through the steps of adding a hydrophilic resinous material to the waste in an amount sufficient to set up and cure into a solid block, mixing the materials together to provide the desired distribution of waste materials therein, and curing the material to a solid mass.

In general, it is believed that any hydrophilic resinous material capable of taking up water upon curing will be suitable to render the wetted or water-carried waste material immobile and shielded therewithin. However, the preferred hydrophilic resin is any of the usual urea-formaldehyde compositions, which are available commercially in the partially polymerized state, and capable of curing to a high polymer upon the addition of an acidic curing agent. After the radioactive waste material is thus immobilized within a solid block of hydrophilic resinous material, it may be waterproofed to protect against leaching, if desired. This objective may be achieved by the addition of a substantially waterproof resin as a coating thereover, or by a cover or any other protective waterproofing material that will prevent transfer of water from within to the outside and reverse.

Another object of the present invention is to provide improvements within this general process of providing a safe immobilized waste product, and to increase the efficiency of the use of materials and the like used up in the process.

Thus in the preferred form of the invention, the radioactive waste material is first concentrated to a level more suitable for disposal, but still at a sufficiently low level so as to remain within the low hazard classifications. Where the radioactive material is present in water, this concentration is obtained by water removal. In the case of removal of radioactive waste from the water in the cooling loop of a reactor, the removed water may advantageously be returned to usage for further cooling.

In such a case, water containing radioactive ions such as radioactive iron, nickel, and cobalt, are brought in contact with ion exchange resin beads capable of taking up such cations and holding them within the resin mass. The water which is thus deionized and thereby has its radioactive metallic ion component substantially removed is returned to the cooling loop, and the wet resin beads containing the radioactive components are then disposed of by encapsulating them within a hydrophilic resinous material as explained above, In general, any ion exchange resin capable of picking up radioactive waste components may be used. However, where it is desired to remove iron, nickel and cobalt ions, cation exchangers should be used. Cation exchange resins are well known, and available commercially. A typical ion exchange resin preferred in the practice of the process of this invention has a styrene-divinylbenzene matrix which is suitably sulfonated to provide a strongly acidic, cation exchange resin in the form of beads. Such resins are sufficiently dense and insoluble in water to provide easy separation, yet are sufficiently hydrophilic to provide the desired ion exchange activity as well as to provide compatability with the hydrophilic resins utilized in accordance with the present invention.

It will be appreciated that absorbing agents in general, which may or may not be classified as ion exchange resins, but which are capable of picking up the desired radioactive component are also suitable. In this connection, materials such as diatomaceous earth, Powdex (powdered filter aid) Solco Foc (wood cellulose flour) and the like are suitable. In such case, the substances may be filtered out advantageously to provide solids having concentrates of wastes therein. When a typical ion exchange resin is used, instead of filtering same, the resin may be regenerated after separation in a more concentrated solution and the regenerated resin beads recycled for reuse. Another method of concentrating the materials is simply by vacuum evaporation of the water, and the water vapor may be condensed and returned again to the process from whence it came, if desired.

While it will be seen that any of these methods for concentrating the waste materials may be suitable in and of themselves, it is also sometimes advantageous to provide a combination of methods so as to provide a controlled concentration of waste and water in proper proportion for mixture with the resin. In addition, filter aids and filtration may be utilized instead of ion exchange beads to concentrate the materials and locate them in certain desired areas within the final solid resinous block. It is also desirable to add filler material or the like to extend the resin and also act as an additional shield for the radioactive components.

In other words, the solids of this invention not only hold and immobilize the waste material, but they provide a primary shield therefor so that the radiation such as hard gamma rays are reduced before leaving the solid mass in which the radioactive sources are contained. It will also be appreciated that any other suitable filler material may be added to the resinous components in accordance with those materials suggested in the literature for use with the particular resin involved. In all such cases, the amount of filler will be determined by conventional standards, i.e. the amount which will best extend and increase the use of the resin itself, but will stay within the ranges of physical properties desired for the final composition.

The use of hydrophilic resins in accordance with the present invention is particularly advantageous with regard to handling of water solutions and wet materials. Such handling not only has the advantage of allowing water to be utilized as a carrier for pumping and other handling and the like, but it also provides the build-up advantages of having water present during the exothermic polymerization reaction. During polymerization, the high heat capacity of the water prevents undue heat built up and provides for proper curing without thermal breakdown. In addition, it provides a convenient method for getting rid of water that may contain waste in and of itself either as a primary carrier, or as a cleaner utilized to flush out radioactive material from the system.

It has also been found that Portland Cement and hydrophilic resinous materials do not hold the water and associated ions in a sufficiently strong bond for certain disposal applications, such as disposal at sea. In such cases, it is contemplated that the solid mass will be further encapsulated in one or more waterproof materials. For example, the solid waste block may be advantageously prepared in a metal container such as a drum and the metal container disposed of along with the resin and waste product. In such a case, however, the metal container may disintegrate or corrode away and expose the resin block too quickly, particularly when subjected to corrosive action of sea water. Accordingly, it is preferred to coat and capsulate or otherwise cover the hydrophilic resin block containing the waste material therein. In other words, a substantially waterproof or water impervious resinous material in the form of a coating or a bag or any other device that will assure containment may be used. If desired, such further material may be carried in a metal container.

For example, the process of this invention may be practiced by utilizing a large metal container such as a drum, lining the container with a polyethylene bag material, with the sides extending sufficiently to provide a fold-over enclosure. With the procedure, the radioactive waste material, resin components, and any other of the materials suggested for use in accordance with the process of this invention are then added, and the resin cured to provide a solid block within the plastic bag and held within the container. The bag is then folded over the top and sealed to provide a waterproof coating, and the metal container is then closed. Where such a container is used, leaching of the waste materials will not occur even after the metal container has corroded away.

Alternative to the bag process, it may be advantageous to utilize resins that will adhere to the hydrophilic resin utilized in the primary process. Such processes may be carried out by first curing a base lining in the bottom of the container, then curing the plastic mass within the container, with curing providing a certain amount of shrinkage, and then curing the waterproof or water repellent resin in the further stage around the side and top so as to completely fill the container and provide a water resistant protective layer. For example, when the preferred urea-formaldehyde resin is used for solidifying and retaining the radioactive waste material in accordance with this invention, the water resistant material may be a butylated urea-formaldehyde or a melamine-formaldehyde resin. These resins have improved resistance to a leaching effect of water. Alternatively, a typical hydrophobic resinous material may be utilized instead of, but in the same manner, by using an asphaltic or bituminous material first as a layer on the bottom and then to fill the side and top voids after processing and shrinking.

Further alternatives and advantages of the invention will become apparent as the specification progresses and the new and useful features of the radioactive disposal described herein will be more fully defined in the claims attached hereto.

DESCRIPTION OF THE PREFERRED EMBODIMENTS

The preferred hydrophilic resin to be used in accordance with this invention is any of the urea-formaldehyde resins available from a plurality of commercial sources as standard articles of commerce. These resins are prepared by reacting urea and formaldehyde in mol ratios between about 1:1 and 1:4 respectively, and preferably between 1:1.5 and 1:2.5. For optimum results, the mol ratio is about 1 part urea to about 2 parts formaldehyde. Typically, solid urea and an aqueous solution of formaldehyde are reacted with one another to produce a resin syrup that is in the thermosetting state but capable of being converted to a thermoset state. These resins are available in syrup form, and sometimes available in a spray-dried form, which may be redispersed in water to a desired solids content. Since part of the water will come from the waste material, the urea-formaldehyde should be in a concentrated form with the final ratio of resin solids and water being present in the final dispersion in a ratio of about 2½ to about 5 parts water per part resin by weight and preferably from about three to about 4 parts water per part resin solids.

A typical catalytic material used to convert the urea resin to a thermoset state at ambient temperature is an acidic material having a dissociation constant between about $10^0$ to $10^{-5}$. The amount of catalytic material used will depend upon the strength of the acidic material used and upon the nature of the composition in which it is used. For example, materials like boric acid tend to inhibit the polymerization, and therefore increased catalyst is required to achieve the same cure time. However, generally the amount of acidic catalytic material will be between say about 0.3 and 20% by weight of the resin solids in the mixture. In general, any acid capable of providing a pH below 5 in the dispersion may be utilized, as is well known in the art, and it is preferred to utilize sodium bisulfate, since it is available as a solid and provides an excellent strength acid.

Certain materials such as filter aids, ion exchange resins and materials that act as one of these or both are usually added in order to improve processing and provide the most economical and practical way to eliminate waste. However, any of these materials which are compatible with the urea-formaldehyde are suitable, and considerable latitude is permissible in this area.

In order to illustrate the preferred procedures of the present invention, the following examples are set forth. However, it should be understood that these examples are primarily for the purpose of illustration and any enumeration of detail contained therein should not be construed as a limitation.

EXAMPLE 1

Water from a reactor cooling loop containing radioactive isotopes of the iron family is passed through a conduit packed with 1200 milliliters of resin beads, which beads are composed of a cation exchange resin available commercially (specifically a sulfonated styrene-divinylbenzene polymer). In this way, radioactive cationic materials are removed from the water and collected by the resin beads. The water is allowed to drain from the beads and the wet beads are then placed in a five gallon container. A 2000 ml solution or dispersion of urea-formaldehyde resin is then prepared by adding 1200 ml water to 800 ml of a dispersion containing about 63–66% solids. This diluted dispersion is then added to the wet beads in the container, and the mixture stirred by an electric stirrer at a speed sufficient to keep the resin beads substantially evenly distributed in the mixture. 50 ml of a saturated solution of sodium bisulphate is then added gradually with the stirring being continued. After the sodium bisulfate is added and the mixture gels sufficiently to hold the resin beads from sinking by gravity, the stirring is discontinued and the stirring blades disconnected and left in the mixture. The gel is then allowed to set until the cure is complete, whereupon the unit is ready for disposal.

EXAMPLE 2

Water from a reactor cooling loop containing radioactive waste is mixed with 1200 ml of powdered ion exchange filter aid available in the trade as Powdex. The Powdex is then filtered and added to a 5 gallon container. A 1200 ml solution or dispersion of urea-formaldehyde resin is then prepared by adding 900 ml water to 300 ml of a dispersion containing about 63–66% solids, and the urea-formaldehyde dispersion added to the five gallon container. The mixture is stirred by an electric stirrer, and 150 ml of a saturated solution of sodium bisulfate is added while continuing the stirring. After the solution gels, the stirring is discontinued and the mixture allowed to cure into a solid thermoset mass.

EXAMPLE 3

Water from a reactor cooling loop containing radioactive waste is mixed with 1200 ml diatomaceous earth, and the diatomaceous earth removed by filtration. 1200 ml of urea-formaldehyde dispersion similar to that used in Example 2, and the treated diatomaceous earth is added to a five gallon container. These materials are stirred with an electric stirrer and 100 ml of a saturated solution of sodium sulphate is added. After the solution gels, the stirring is discontinued and the mixture allowed to cure into a solid thermoset mass.

EXAMPLE 4

Water from a reactor cooling loop containing radioactive waste is placed in a vacuum and about 80% of the water removed by vacuum evaporation. 900 ml of the evaporated waste water and 1200 ml of a wood celulose flour is added to a five gallon container. 300 ml of a urea-formaldehyde dispersion containing about 63–65% solids is also added. The ingredients are then stirred with an electric stirrer and 150 ml of saturated sodium bisulfate is added. After the solution gels the stirring is discontinued and the mixture is allowed to cure into a solid theremoset mass.

EXAMPLE 5

The procedure of Example 4 is repeated, except that the evaporated waste water contains borate moities in the amount of about 20% by weight of the solution calculated as boric acid. Similarly good results are obtained.

EXAMPLE 6

Water from a reactor cooling loop containing radioactive waste is flashed in a vacuum to remove about 80% of the water. Another portion of water from the reactor cooling loop is passed through a conduit packed with 1200 ml of ion exchange resin beads similar to those of Example 1. 1200 ml of the evaporated water, the ion exchange resin beads, and 800 ml of a urea-formaldehyde dispersion containing about 63–65% solids are mixed together by an electric stirrer and 50 ml of a saturated solution of sodium bisulphate is added. After the solution gels, the stirring is discontinued and the mixture is allowed to cure into a solid thermostat mass.

The samples obtained from the procedures set forth above are compared with similar samples made with Portland Cement. In all cases, the samples made with the urea-formaldehyde were as good as or better than those made with Portland Cement. Of particular note, is the fact that certain of the cement samples did not set at all. Moreover, contact of the other cement samples with sea water caused them to crack, while the resin samples remained intact under similar circumstances.

From the foregoing description, it is seen that there has been provided an improved method of disposal of radioactive waste material, and particularly an improvement over the process using cement heretofore in major usage.

We claim:

1. The method of solidifying radioactive waste material containing free water into a free standing body, comprising:

A. providing a mixture of radioactive waste material and water in a controlled amount sufficient to meet a desired low hazard radiation classification when solidified with urea-formaldehyde and urea-formaldehyde in a partially polymerized state in an amount sufficient to solidify substantially all of the water present, B. adding an acidic curing agent capable of promoting polymerization of said urea-formaldehyde in an amount sufficient to solidify said urea-formaldehyde in said mixture, and C. stirring the materials together to provide the desired distribution of radioactive waste material and allowing the mixture to gel and set whereby a solid mass of the resin is obtained with the water and the radioactive components of the resulting mixture distributed therein.

2. The method described in claim 1 wherein said acidic curing agent is an acidic material having a dissociation constant between about $10^{0}$ and $10^{-5}$.

3. The method described in claim 2 and wherein said curing agent is a water solution of sodium bisulphate.

4. The method described in claim 1 and wherein the urea-formaldehyde comprises a resin syrup of partially polymerized urea-formaldehyde in water.

5. The process of claim 1 in which the radioactive waste material is obtained from radioactive cooling water for atomic reactors by removing water to concentrate the waste material.

6. The process of claim 1 in which the radioactive waste material is a high intensity waste obtained as a slurry by taking up the radioactive waste from cooling water for atomic reactors by using an insoluble absorbent agent and removing a portion of the water from the slurry.

7. A process of claim 6, in which the insoluble absorbent agent is an ion exchange resin.

8. A method of disposing of radioactive waste as defined in claim 1, in which a filler material is added to extend the urea-formaldehyde and provide additional shielding.

9. A method of processing wet radioactive waste material for safe disposal comprising the steps of:

A. placing the wet waste material in an impervious noncorrosive container,

B. providing a mixture of the wet radioactive waste material and water in a controlled amount sufficient to meet a desired low hazard radiation classification when solidified with urea-formaldehyde, C. adding urea-formaldehyde in a partially polymerized state in an amount sufficient to solidify substantially all of the water present, D. mixing the wet waste material and urea-formaldehyde to provide a body of urea-formaldehyde with waste material dispersed therein, E. adding an acidic curing agent to the mixture in an amount capable of promoting polymerization of said urea-formaldehyde in said mixture, F. stirring the materials together to provide the desired distribution of radioactive waste material and allowing the mixture to gel and set whereby a solid mass of the resin is obtained with the water and the radioactive components of the resulting mixture distributed therein, and G. sealing said impervious noncorrosive container to thereby prevent leaching of said solid resinous substance.

10. A method of disposing of radioactive waste carried in water, the steps of:

A. placing the water and waste material in a plastic bag,

B. providing a mixture of the water and waste material in a controlled amount sufficient to meet a desired low hazard radiation classification when solidified with urea-formaldehyde.

C. adding a urea-formaldehyde resin in a partially polymerized state in an amount such that the water present in the mixture and in the urea-formaldehyde resin added would form a dispersion of from about 20 to about 40% by weight of said resin based on the resin solids content of the combined weight of said resin and water present, and said amount being sufficient to solidify substantially all of the water present, D. mixing the components together to disperse the waste throughout said resin, E. adding an acidic material in an amount sufficient to solidify said urea-formaldehyde in said mixture and having a dissociation constant between about $10^{0}$ and $10^{-5}$, F. stirring the materials together to provide the desired distribution of radioactive waste material and allowing the mixture to gel and set whereby a solid mass of the resin is obtained with the water and the radioactive components of the resulting mixture distributed therein, and G. folding the top of said plastic bag and sealing said plastic bag to thereby prevent leaching of said waste.

11. The process of claim 10 in which the radioactive waste material is obtained from radioactive cooling water for atomic reactors by removing water to concentrate said radioactive waste.

12. The process of claim 10 in which the radioactive waste material has high intensity radiation components obtained as a slurry by taking up the radioactive waste from cooling water for atomic reactors by using an insoluble adsorbent agent and removing a portion of the water from the slurry.

13. A process of claim 12, in which the insoluble absorbent agent is an ion exchange resin.

14. A method of disposing of radioactive isotopes dispersed or dissolved in water, comprising the steps of:

A. providing a mixture of radioactive isotopes and water in a controlled amount sufficient to meet a desired low hazard radiation classification when solidified with urea-formaldehyde, B. admixing the water and radioactive isotopes with urea-formaldehyde resin in a partially polymerized state with the proportions of urea-formaldehyde resin and water in the mixture being from about 20 to about 40% by weight of said resin based on the resin solids content of the combined weight of said resin and water present, said amount being sufficient to solidify substantially all of the water present, C. mixing the components together, D. adding an acidic material having a dissociation constant between about $10^{\circ}$ to $10^{-5}$ and in an amount sufficient to solidify said urea-formaldehyde in said mixture and E. stirring the materials together to provide the desired distribution of radioactive isotopes and allowing the mixture to gel and set whereby a solid mass of the resin is obtained with the water and the radioactive isotopes of the resulting mixture distributed therein, and F. coating the solid mass thus formed with a water impervious resinous material.

15. A method of disposing of radioactive isotopes in the form of metallic ions carried as waste material in water, comprising the steps of:

A. adding particles of an ion exchange resin to the water for a time sufficient to take up the radioactive metal ions in the water, B. removing the particles of an ion exchange resin from the water, C. providing a mixture of the ion exchange resin particles and water in a controlled amount sufficient to meet a desired low hazard radiation classification when solidified with urea-formaldehyde, D. then adding the ion exchange resin particles to an aqueous dispersion of urea-formaldehyde resin, with the proportions of urea-formaldehyde resin and water present in the mixture being such that a dispersion of said urea-formaldehyde resin and the water present would contain from about 20 to about 40% by weight of said urea-formaldehyde resin based on the resin solids content of the combined weight of said urea-formaldehyde resin and water present, and the amount of urea-formaldehyde being sufficient to solidify substantially all of the water present, E. mixing the components together to provide a desired dispersion of waste within the urea-formaldehyde.

F. adding an acidic material having a dissociation constant between about $10^{\circ}$ and $10^{-5}$ and in an amount sufficient to solidify said urea-formaldehyde in said mixture, G. stirring the materials together to provide the desired distribution of said ion exchange resin particles and allowing the mixture to gel and set whereby a solid mass of the resin is obtained with the water and the radioactive components of the resulting mixture distributed therein.

16. A method of disposing of radioactive isotopes carried as waste material in water, comprising the steps of:

A. evaporating a portion of the water to concentrate the waste material therein, B. thereby providing a mixture of radioactive waste material and water in a controlled amount sufficient to meet a desired low hazard radiation classification when solidified with urea-formaldehyde, C. adding an aqueous dispersion of urea-formaldehyde resin to the concentrated waste, with the proportions of urea-formaldehyde resin and water present in the mixture being such that a dispersion of said resin and the water present could contain from about 20 to about 40% by weight of said resin based on the resin solids content of the combined weight of said resin and water present, and the amount of urea-formaldehyde being sufficient to solidify substantially all of the water present, D. mixing the components together, and E. adding an acidic material having a dissociation constant between about $10^{\circ}$ and $10^{-5}$ and in an amount sufficient to solidify said urea-formaldehyde in said mixture, and F. continuously stirring the resulting mixture to provide the desired distribution of waste material and until the mixture gels and allowing the gel to set whereby a solid mass of the resin is obtained with the water and the radioactive components of the resulting mixture distributed therein.

17. A method of disposing of radioactive isotope waste as defined in claim 16, in which a filler material is added to extend the resin and provide additional shielding.

18. A method of disposing of radioactive isotope waste as defined in claim 16, in which the radioactive isotopes include cobalt 60.

19. A method of disposing of radioactive isotopes in the form of cationic waste material in water, comprising the following steps in the order given:

A. taking a first portion of carrier water and included waste material and bringing said portion into contact with ion exchange resin particles activated to take up cations for a time sufficient to take up substantially all of said cationic waste material, and removing the thus treated ion exchange resin particles from the major portion of the water, B. taking a second portion of carrier water and included waste material and concentrating said second portion by evaporating water therefrom, combining the treated resin particles and said concentrated second portion with a partially polymerized urea-formaldehyde resin, the proportions of said mixture being adjusted to provide a mixture sufficient to meet a desired low hazard radiation classification, and in which the portions of urea-formaldehyde resin and water present in the mixture are such that a dispersion of said urea-formaldehyde resin and the water present would contain from about 20 to about 40% by weight of said urea-formaldehyde resin based on the resin solids content of the combined weight of said urea-formaldehyde resin and water present, said amount being sufficient to solidify substantially all of the water present in said mixture, C. and adding an acidic material in an amount sufficient to solidify said urea-formaldehyde in said mixture and having a dissociation constant between about $10^{0}$ and $10^{-5}$ to the mixture, D. and stirring the materials together to provide the desired distribution of radioactive waste material and allowing the mixture to gel and set whereby a solid mass of the resin is obtained with the water and cationic waste material of the resulting mixture distributed therein.

20. A method of disposing of radioactive isotopes as defined in claim 19, in which the radioactive isotopes include cobalt 60.

21. A method of disposing of radioactive isotopes as defined in claim 19, in which the proportions of urea-formaldehyde resin and water present in the mixture are such that a dispersion of said urea-formaldehyde resin and water present would contain from about 25 to about 35% by weight of said urea-formaldehyde resin based on the resin solids content of the combined weight of said urea-formaldehyde resin and water present.

* * * * *